US006516830B1

(12) United States Patent
Gmeiner

(10) Patent No.: US 6,516,830 B1
(45) Date of Patent: Feb. 11, 2003

(54) DEVICE FOR GUIDING BACKWATER PRODUCED IN A PAPER MACHINE

(75) Inventor: Anton Gmeiner, Ravensburg-Sickenried (DE)

(73) Assignee: Voith Sulzer Papiertechnik Patent GmbH, Ravensburg (DE)

( * ) Notice: Subject to any disclaimer, the term of this patent is extended or adjusted under 35 U.S.C. 154(b) by 0 days.

(21) Appl. No.: 09/666,793

(22) Filed: Sep. 21, 2000

(30) Foreign Application Priority Data

Sep. 23, 1999 (DE) ..... 299 16 787 U

(51) Int. Cl.[7] ..... D21F 1/66

(52) U.S. Cl. ..... 137/590.5; 137/599.01; 162/190; 162/264

(58) Field of Search ..... 137/599.01, 599.11, 137/601.18, 57, 590.5, 561 A; 162/190, 264, 380

(56) References Cited

U.S. PATENT DOCUMENTS 1,139,129 A * 5/1915 Lyons ..... 137/590
2,903,166 A * 9/1959 Kuljian
4,443,232 A * 4/1984 Kaiser ..... 162/190
4,455,224 A * 6/1984 Kaiser ..... 162/380
4,908,102 A * 3/1990 Zag et al. ..... 162/190
5,567,278 A * 10/1996 Meinander ..... 162/190
5,958,189 A * 9/1999 Begemann et al. ..... 162/264

* cited by examiner

*Primary Examiner*—Stephen M. Hepperle
(74) *Attorney, Agent, or Firm*—Greenblum & Bernstein, P.L.C.

(57) ABSTRACT

Apparatus and process for guiding portions of backwater produced or stored at different levels of a machine. The apparatus includes an upper backwater chamber arranged to receive first backwater, a lower backwater chamber arranged below the upper backwater chamber and to receive at least a portion of the first backwater from the upper backwater chamber. A plurality of hydraulic lines are arranged to couple the upper backwater chamber to the lower backwater chamber, and inlet openings of the plurality of hydraulic lines are arranged inside the upper backwater chamber and are arranged at different geodetic heights relative to one another. The process includes collecting first backwater in an upper backwater chamber, and guiding the first backwater from the upper backwater chamber to a lower backwater chamber through inlet openings to a plurality of hydraulic lines. The inlet openings are arranged at different geodetic heights relative to one another.

15 Claims, 3 Drawing Sheets

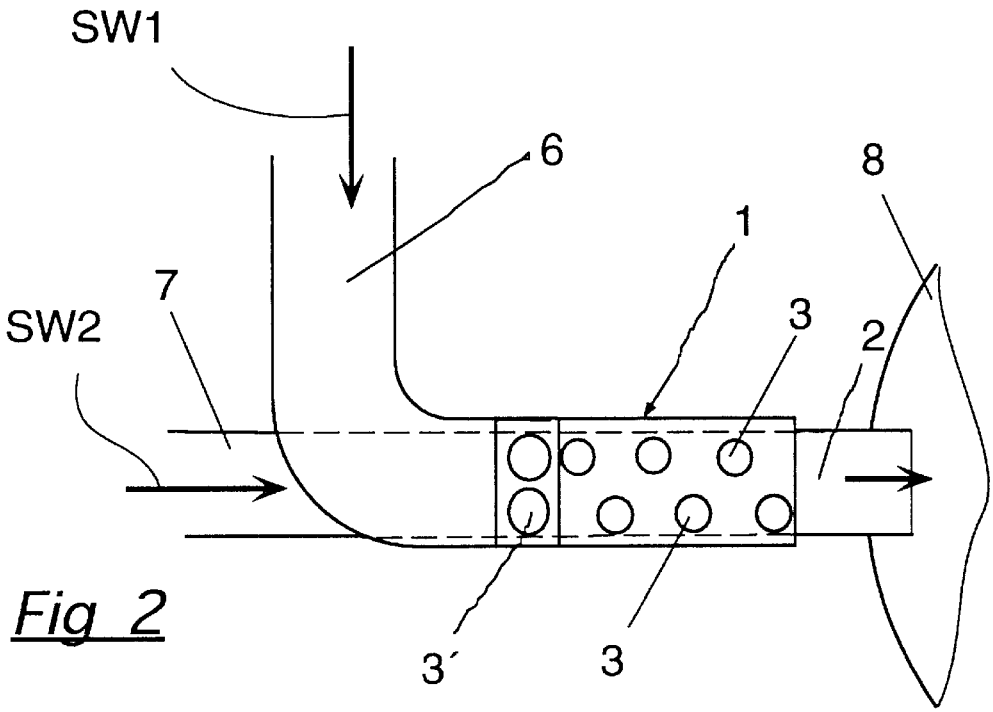
Fig 2
Fig.3
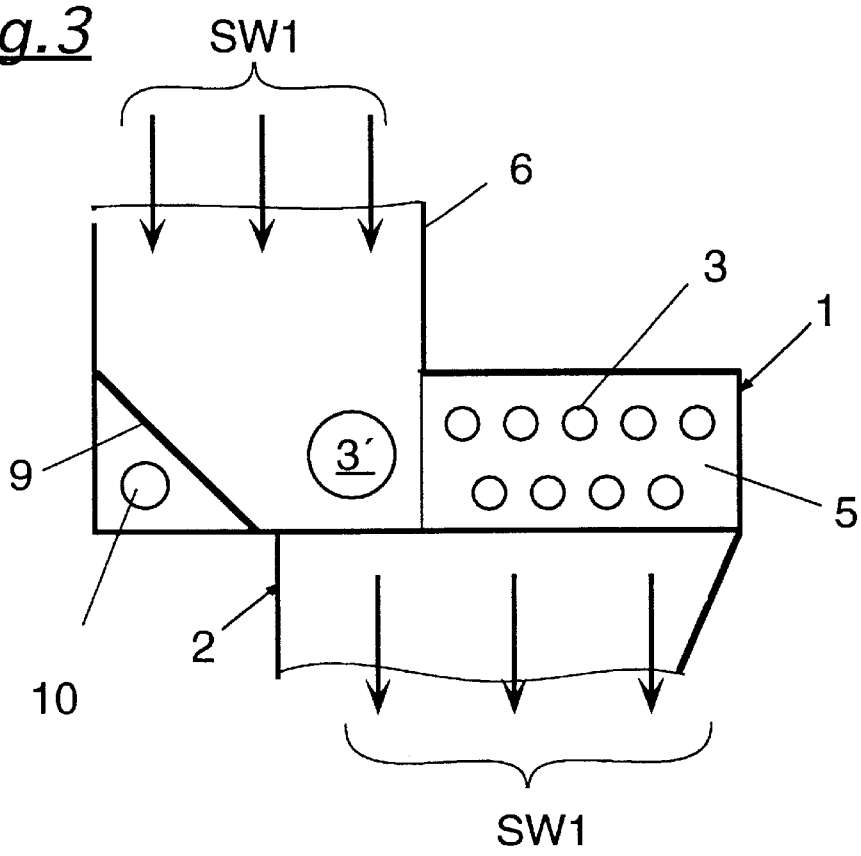

DEVICE FOR GUIDING BACKWATER PRODUCED IN A PAPER MACHINE

CROSS-REFERENCE TO RELATED APPLICATIONS

The present application claims priority under 35 U.S.C. § 119 of German Patent Application No. 299 16 787.9, filed on Sep. 23, 1999, the disclosure of which is expressly incorporated by reference herein in its entirety.

BACKGROUND OF THE INVENTION

1. Field of the Invention

The invention relates to a device for guiding portions of backwater produced or stored at different levels of a paper machine. The device includes an upper backwater chamber for the backwater being produced higher up and a lower backwater chamber arranged farther below into which the backwater from the upper backwater chamber can flow.

2. Discussion of Background Information

In the operation of a paper machine, the water from the paper suspension is either thrown off through the wires in the paper machine or scraped off with the aid of foils. This water, i.e., the backwater, is produced in large amounts in a small space. Devices of the type discussed here are appropriate for removing the backwater from the vicinity of the paper machine. In many paper machines, various partial flows of the backwater must be brought together from various geodetic heights for re-use. In this connection, vertical flows (waterfalls) may form. They have the disadvantage that they entrain and incorporate parts of the surrounding air.

It is not always simple to manage with the space available for this purpose in a paper machine because, due to the large amount of water, it is necessary to keep the flow cross sections for such backwater flows wide and favorable to flowing. Therefore, enough space is seldom available for removing the backwater without vertical flows.

SUMMARY OF THE INVENTION

The present invention provides a device with which it is possible to bring together parts of the backwater from various geodetic heights in a space-saving manner and with as little entrainment of air as possible. Fluctuations in the amount of water should be problem-free as well.

In particular, the present invention provides a device similar to that discussed above, but in which the upper backwater chamber is connected to the lower backwater chamber via several hydraulic lines having inlet openings inside the upper backwater chamber. Further, these inlet openings are arranged at different geodetic heights relative to one another.

With the aid of the device according to the invention, the differences in height can be overcome with extremely little entrainment of air. The predominant part of the backwater can flow off downwardly through lines that are completely filled with water. The inlet openings lie at different heights such that, in general, just one single line will be only partially filled with backwater, whereas the inlet openings of the others are located either completely below or above the water level. The number of hydraulic lines with water flowing through them will differ, depending on the water level in the upper backwater chamber.

The present invention is directed to an apparatus for guiding portions of backwater produced or stored at different levels of a machine. The apparatus includes an upper backwater chamber arranged to receive first backwater, a lower backwater chamber arranged below the upper backwater chamber and to receive at least a portion of the first backwater from the upper backwater chamber. A plurality of hydraulic lines are arranged to couple the upper backwater chamber to the lower backwater chamber, and inlet openings of the plurality of hydraulic lines are arranged inside the upper backwater chamber and are arranged at different geodetic heights relative to one another.

In accordance with a feature of the instant invention, the lower backwater chamber can be further arranged to receive a second backwater, and the first backwater can be produced higher up in the machine than the second backwater.

According to another feature of the invention, the upper backwater chamber can include an inclined floor, and the inlet openings may be coupled to the inclined floor. An angle of the inclined floor to horizontal may be between about 30° and 60°.

In accordance with still another feature of the present invention, at least some of inlet openings may lie above a floor of upper backwater chamber.

An hydraulic line coupled to a lowermost inlet opening can have a free cross-sectional area that is at least three times as large as a remainder of the plurality of hydraulic lines. The remainder of the hydraulic lines can have a free cross-section of between about 100 and 300 $cm^2$.

According to a further feature of the present invention, the plurality of hydraulic lines can be round. Additionally, or alternatively, the plurality of hydraulic lines can be annular lines arranged concentrically to one another.

In accordance with still another feature of the instant invention, the plurality of hydraulic lines can be arranged to terminate below a backwater level in the lower backwater chamber.

The lower backwater chamber may be coupled to a fluid guiding element arranged to receive a portion of second backwater produced at a lower level than the first backwater. The fluid guiding element is a channel.

Further, the lower backwater chamber can be coupled to a downstream backwater tank, relative to a backwater flow direction.

The inlet openings may be arranged such that a lowest point of one inlet opening is at a same level as a highest point of an adjacent inlet opening.

Moreover, according to the instant invention, a level of the backwater in the upper backwater chamber may partially fills one of the inlet openings.

A weir and an overflow drain can be provided. The weir may control a maximum backwater level in the upper backwater chamber.

The inlet openings can be obliquely angled relative to the plurality of hydraulic lines. A portion of a bottom of the upper backwater chamber may be angled relative to horizontal, and the angle of the bottom may correspond to the oblique angle of the inlet openings. The inlet openings can be arranged such that a lowest point of one inlet opening is at a same level as a highest point of an adjacent inlet opening. Further, a lowermost inlet opening arranged at an end of the bottom. Additionally, or alternatively, the hydraulic lines can be concentrically arranged. A lowermost inlet opening can be arranged at a lowermost point of the upper backwater chamber.

In accordance with still another feature of the present invention, the machine can be a paper machine.

The present invention is directed to a process of guiding backwater produced or stored at different levels in a machine. The process includes collecting first backwater in an upper backwater chamber, and guiding the first backwater from the upper backwater chamber to a lower backwater chamber through inlet openings to a plurality of hydraulic lines. The inlet openings are arranged at different geodetic heights relative to one another.

According to a feature of the present invention, a level of the first backwater in the upper backwater chamber is such that one of the inlet openings can be partially filled with the first backwater.

The process can further include guiding the first backwater into the lower backwater chamber at a level below a second backwater level contained in the lower backwater chamber.

The first backwater may be guided through concentrically arranged hydraulic tubes.

In accordance with still yet another feature of the instant invention, a first backwater level can controlled by a weir and an overflow drain.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 2 illustrates a top view of a device similar to the one depicted in FIG. 1;

FIG. 3 illustrates a top view of another embodiment of the instant invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
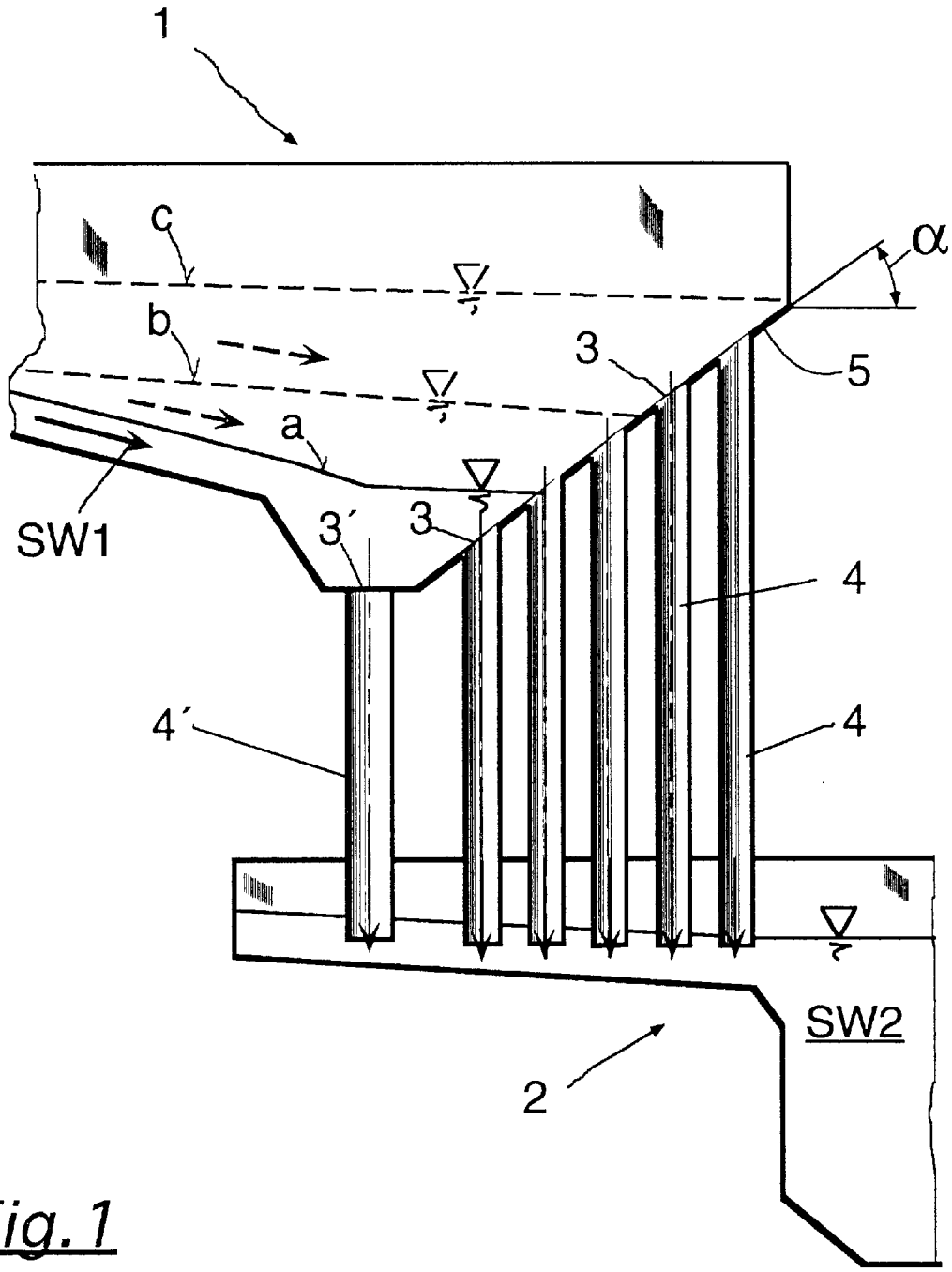
FIG. 1 schematically illustrates a front view of a portion of the device according to the instant invention.

FIG. 1 illustrates an upper backwater chamber 1, which is arranged geodetically above the lower backwater chamber 2. Upper backwater chamber 1 contains an inclined floor 5 whose incline is defined by an angle $\alpha$ to the horizontal. The incline in the exemplary illustration is, e.g., approximately 45°. The floor can also have a variant form, e.g., it can be arched or graduated. For the hydraulic connection between upper and lower backwater chambers 1 and 2, a plurality of hydraulic lines 4 are shown whose inlet openings 3 lie in the region of inclined floor 5. A further hydraulic line 4' with a inlet opening 3' is located at the lowest point in upper chamber 1. The function of the device according to the instant invention is as described in the following. Backwater SW1 flows into, and partially fills, upper backwater chamber 1, reaching, e.g., water level a. Backwater SW1 then flows down into second backwater chamber 2 such that hydraulic lines 4 and 4' opening below water level a are completely filled with water, while inlet opening 4" is only partially covered. Because the inflow amount of backwater SW1 varies in practice, other water levels, e.g., level b and level c, can arise. The exemplary embodiment shows that, even in the case of a varying level of backwater SW1, a majority of backwater flows away through completely filled lines, which leads to a small amount of air being entrained overall. Advantageously, lines 4 and 4' can be immersed in backwater SW2 in lower backwater chamber 2. In the embodiment shown, this is where additional backwater SW2 flows, which has been produced at a lower part of the paper machine. Thus, the device is especially space-saving, and, if necessary, the angle $\alpha$ a can also be different, e.g., steeper, than as shown here.

FIG. 2 shows a top view of a similar device according to the features of the present invention. Two different portions of backwater SW1 and SW2, which have been produced at different levels, can be fed to the device through channels 6 and 7. A first portion of backwater SW1 flows into upper backwater chamber 1, and then flows off through inlet openings 3' and 3 into lower backwater chamber 2, where it can be combined with a second portion of backwater SW2. The amount of water brought together in this manner will then arrive, e.g., in backwater tank 8.

FIG. 3 shows a further exemplary embodiment in which backwater SW1, arriving at a higher level, is drawn in above and indicated by three arrows. Channel 6 receiving backwater SW1 expands laterally into an upper backwater chamber 1, which again has an inclined floor 5 in which relatively large inlet openings 3 are visible. The lowest point of the backwater chamber 1 is provided with a relatively large inlet opening 3'. All inlet openings continue into hydraulic lines that empty into lower backwater chamber 2, into which backwater SW1 subsequently flows. It can also be mixed with other backwater produced at different parts of the machine (not shown). Furthermore, an overflow wall 9 can be arranged in upper backwater chamber 1, which can be, e.g., in the form of a dam or weir to divert an excessive influx of backwater SW1. An overflow opening 10 can be provided for diverting the overflow backwater.

Figure 4:
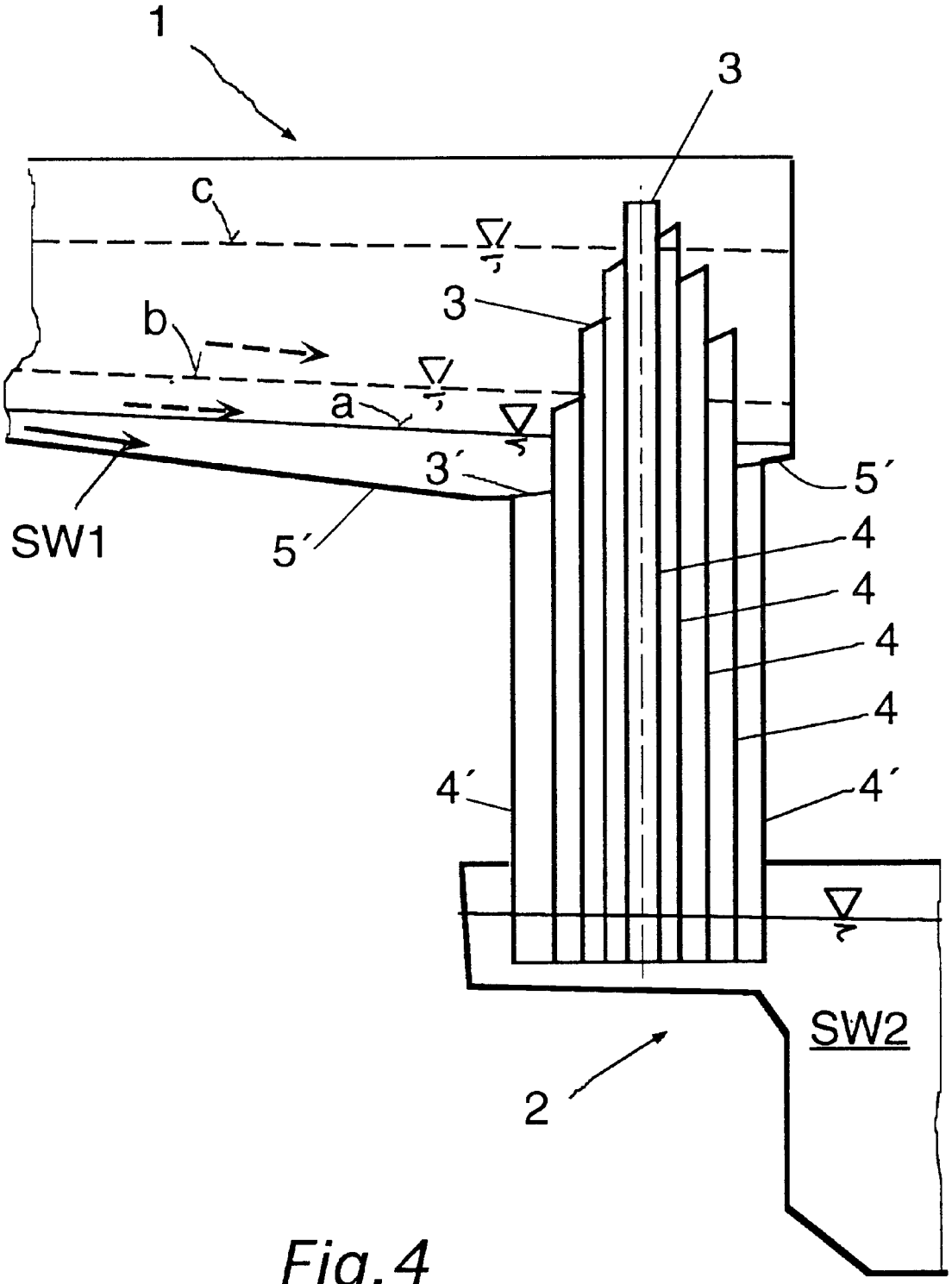
FIG. 4 illustrates a further embodiment of the invention.

The embodiment according to FIG. 4 can be built in a particularly compact fashion. Lines 4' form tubes concentrically arranged inside one another whose inlet openings 3 lie above floor 5'. Lowermost inlet opening 3' of line 4' terminates at floor 5'. Inlet openings 3 can be inclined relative to the horizontal, and they can be formed in such a way that a highest point of one inlet opening lies at a same height as a lowest point of a next higher inlet opening. (This is also true for the embodiment shown in FIG. 1.)

While production would be simpler if the inlet openings were not inclined, i.e., but were level, it could be expected that outflow of the water during operation would not be entirely even.

Separate lines arranged next to one another, as shown principally in FIG. 1, can also end above the floor 5 of upper backwater chamber 1.

It is noted that the foregoing examples have been provided merely for the purpose of explanation and are in no way to be construed as limiting of the present invention.

While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An apparatus for guiding portions of backwater produced or stored at different levels of a machine, comprising:

an upper backwater chamber arranged to receive first backwater;

a lower backwater chamber arranged below said upper backwater chamber and to receive at least a portion of said first backwater from said upper backwater chamber;

a plurality of hydraulic lines arranged to couple said upper backwater chamber to said lower backwater chamber; and inlet openings of said plurality of hydraulic lines being arranged inside said upper backwater chamber and being arranged at different geodetic heights relative to one another, wherein said upper backwater chamber comprises an inclined floor, and said inlet openings are coupled to said inclined floor, and wherein an angle of said inclined floor to horizontal is between about 30° and 60°.

2. An apparatus for guiding portions of backwater produced or stored at different levels of a machine, comprising:

an upper backwater chamber arranged to receive first backwater;

a lower backwater chamber arranged below said upper backwater chamber and to receive at least a portion of said first backwater from said upper backwater chamber;

a plurality of hydraulic lines arranged to couple said upper backwater chamber to said lower backwater chamber; and inlet openings of said plurality of hydraulic lines being arranged inside said upper backwater chamber and being arranged at different geodetic heights relative to one another, wherein an hydraulic line coupled to a lowermost inlet opening has a free cross-sectional area that is at least three times as large as a remainder of said plurality of hydraulic lines.

3. The apparatus in accordance with claim 2, wherein said remainder of said hydraulic lines have a free cross-section of between about 100 and 300 $cm^2$.

4. An apparatus for guiding portions of backwater produced or stored at different levels of a machine, comprising:

an upper backwater chamber arranged to receive first backwater;

a lower backwater chamber arranged below said upper backwater chamber and to receive at least a portion of said first backwater from said upper backwater chamber;

a plurality of hydraulic lines arranged to couple said upper backwater chamber to said lower backwater chamber; and inlet openings of said plurality of hydraulic lines being arranged inside said upper backwater chamber and being arranged at different geodetic heights relative to one another, wherein said lower backwater chamber is coupled to a fluid guiding element arranged to receive a portion of second backwater produced at a lower level than said first backwater.

5. The apparatus in accordance with claim 4, wherein said fluid guiding element is a channel.

6. An apparatus for guiding portions of backwater produced or stored at different levels of a machine, comprising:

an upper backwater chamber arranged to receive first backwater;

a lower backwater chamber arranged below said upper backwater chamber and to receive at least a portion of said first backwater from said upper backwater chamber;

a plurality of hydraulic lines arranged to couple said upper backwater chamber to said lower backwater chamber; and inlet openings of said plurality of hydraulic lines being arranged inside said upper backwater chamber and being arranged at different geodetic heights relative to one another, wherein said inlet openings are arranged such that a lowest point of one inlet opening is at a same level as a highest point of an adjacent inlet opening.

7. An apparatus for guiding portions of backwater produced or stored at different levels of a machine, comprising:

an upper backwater chamber arranged to receive first backwater;

a lower backwater chamber arranged below said upper backwater chamber and to receive at least a portion of said first backwater from said upper backwater chamber;

a plurality of hydraulic lines arranged to couple said upper backwater chamber to said lower backwater chamber; and inlet openings of said plurality of hydraulic lines being arranged inside said upper backwater chamber and being arranged at different geodetic heights relative to one another, wherein said inlet openings are obliquely angled relative to said plurality of hydraulic lines.

8. The apparatus in accordance with claim 7, wherein a portion of a bottom of said upper backwater chamber is angled relative to horizontal, and said angle of said bottom corresponds to said oblique angle of said inlet openings.

9. The apparatus in accordance with claim 8, wherein said inlet openings are arranged such that a lowest point of one inlet opening is at a same level as a highest point of an adjacent inlet opening.

10. The apparatus in accordance with claim 8, further comprising a lowermost inlet opening arranged at an end of said bottom.

11. The apparatus in accordance with claim 7, wherein said hydraulic lines are concentrically arranged.

12. The apparatus in accordance with claim 11, wherein said inlet openings are arranged such that a lowest point of one inlet opening is at a same level as a highest point of an adjacent inlet opening.

13. The apparatus in accordance with claim 12, further comprising a lowermost inlet opening at a lowermost point of said upper backwater chamber.

14. An apparatus for guiding portions of backwater produced or stored at different levels of a machine, comprising:

a paper machine producing at least a first backwater;

an upper backwater chamber arranged to receive said first backwater;

a lower backwater chamber arranged below said upper backwater chamber and to receive at least a portion of said first backwater from said upper backwater chamber;

a plurality of hydraulic lines arranged to couple said upper backwater chamber to said lower backwater chamber; and inlet openings of said plurality of hydraulic lines being arranged inside said upper backwater chamber and being arranged at different geodetic heights relative to one another.

15. A process of guiding backwater produced or stored at different levels in a paper machine, the process comprising:

producing at least a first backwater in the paper machine collecting the first backwater in an upper backwater chamber; and guiding the first backwater from the upper backwater chamber to a lower backwater chamber through inlet openings to a plurality of hydraulic lines, wherein the inlet openings are arranged at different geodetic heights relative to one another.

* * * * *